US008065937B2

(12) United States Patent
Halse

(10) Patent No.: US 8,065,937 B2
(45) Date of Patent: Nov. 29, 2011

(54) METHOD AND DEVICE FOR POSITIONING A POWER TONG AT A PIPE JOINT

(75) Inventor: Helge-Ruben Halse, Kristiansand (NO)

(73) Assignee: Weatherford Rig Systems AS, Kristiansand S (NO)

( * ) Notice: Subject to any disclaimer, the term of this patent is extended or adjusted under 35 U.S.C. 154(b) by 118 days.

(21) Appl. No.: 12/094,767

(22) PCT Filed: Nov. 23, 2006

(86) PCT No.: PCT/NO2006/000425
§ 371 (c)(1),
(2), (4) Date: Jul. 31, 2008

(87) PCT Pub. No.: WO2007/061315
PCT Pub. Date: May 31, 2007

(65) Prior Publication Data

US 2008/0282847 A1 Nov. 20, 2008

(30) Foreign Application Priority Data

Nov. 25, 2005 (NO) ..... 20055576

(51) Int. Cl.
*B25B 13/50* (2006.01)

(52) U.S. Cl. ..... 81/57.35; 81/57.33

(58) Field of Classification Search ..... 81/57.34, 81/57.35, 57.16, 57.24, 57.19, 57.21, 57.36, 81/57.44, 57.33
See application file for complete search history.

(56) References Cited

U.S. PATENT DOCUMENTS

| | | | |
|---|---|---|---|
| 2,459,499 | A | 1/1949 | Castel |
| 2,692,059 | A | 10/1954 | Bolling, Jr. |
| 3,017,621 | A | 1/1962 | Taborsky |
| 3,103,976 | A | 9/1963 | Vries et al. |
| 3,194,313 | A | 7/1965 | Fanshawe |
| 3,273,054 | A | 9/1966 | Cook |
| 3,336,572 | A | 8/1967 | Paull et al. |
| 3,434,046 | A | 3/1969 | Wilson et al. |
| 3,475,038 | A | 10/1969 | Matherne |
| 3,561,811 | A | 2/1971 | Turner, Jr. |
| 3,570,594 | A | 3/1971 | Hamilton |
| 3,780,815 | A | 12/1973 | Barron et al. |
| 3,843,923 | A | 10/1974 | de Vries et al. |
| 3,881,375 | A | 5/1975 | Kelly |
| 3,882,377 | A | 5/1975 | Kelly |

(Continued)

FOREIGN PATENT DOCUMENTS

EP 0 339 005 A1 10/1989

(Continued)

*Primary Examiner* — Hadi Shakeri
(74) *Attorney, Agent, or Firm* — Patterson & Sheridan, L.L.P.

(57) ABSTRACT

A method and device for positioning a power tong (2) at the pipe joint (14) of a pipe string (12), where, after the pipe joint (14) has been brought within the working area of the power tong (2), the power tong (2) must be displaced to a position that corresponds with that of the pipe joint (14), and where a camera (16) which may be displaced in parallel with the pipe (12), and which is linked to a display (18), is displaced until the image of the pipe joint (14) coincides with a marker (40) in the display, whereupon a signal is transmitted to a control (26), indicating that the power tong (2) is to be displaced to a position that corresponds with that of the camera (16) and thereby that of the pipe joint (14).

15 Claims, 3 Drawing Sheets

U.S. PATENT DOCUMENTS 4,110,688 A 8/1978 Bailey
4,120,095 A 10/1978 LeBourg
4,140,991 A 2/1979 Singleton et al.
4,148,013 A 4/1979 Finn et al.
4,202,225 A 5/1980 Sheldon et al.
4,214,842 A 7/1980 Franks
4,295,527 A 10/1981 Russe
4,327,261 A 4/1982 Sheldon
4,403,666 A 9/1983 Willis
4,528,757 A 7/1985 McKeehan et al.
4,565,003 A 1/1986 McLeod
4,591,293 A 5/1986 Levallois et al.
4,821,814 A 4/1989 Willis et al.
4,832,530 A * 5/1989 Andersen et al. ..... 81/57.24
4,964,462 A 10/1990 Smith
4,979,356 A 12/1990 Vatne
5,014,781 A 5/1991 Smith
5,054,550 A 10/1991 Hodge
5,161,438 A 11/1992 Pietras
5,167,173 A 12/1992 Pietras
5,178,045 A 1/1993 Frizot
5,249,208 A 9/1993 Ruzga et al.
5,361,838 A 11/1994 Kilgore
5,390,568 A 2/1995 Pietras
5,429,190 A 7/1995 Kilgore et al.
5,626,192 A 5/1997 Connell et al.
5,720,345 A 2/1998 Price et al.
5,750,896 A 5/1998 Morgan et al.
5,842,390 A 12/1998 Bouligny et al.
6,032,739 A 3/2000 Newman
6,223,629 B1 5/2001 Bangert
6,253,842 B1 7/2001 Connell et al.
6,318,214 B1 11/2001 Buck
6,360,633 B2 3/2002 Pietras
6,411,084 B1 6/2002 Yoo
6,720,764 B2 4/2004 Relton et al.
6,752,044 B2 * 6/2004 Hawkins, III ..... 81/57.34
6,814,149 B2 11/2004 Liess et al.
6,965,230 B2 * 11/2005 Rogers et al. ..... 324/220
2004/0026088 A1 2/2004 Pietras et al.
2004/0174163 A1 9/2004 Rogers et al.
2005/0104583 A1 5/2005 Rogers et al.
2008/0307930 A1 * 12/2008 Veverica et al. ..... 81/57.34

FOREIGN PATENT DOCUMENTS

GB 2 049 518 A 12/1980
GB 2154026 8/1985
WO WO 93/18276 9/1993
WO WO 98/32948 A1 7/1998
WO WO 00/45026 A1 8/2000

* cited by examiner

METHOD AND DEVICE FOR POSITIONING A POWER TONG AT A PIPE JOINT

CROSS REFERENCE TO RELATED APPLICATIONS

This application is the National Stage of International Application No. PCT/NO06/00425, filed on Nov. 23, 2006, which claims benefit of Norwegian Patent Application No. 20055576, filed on Nov. 25, 2005. Each of the aforementioned related patent applications are herein incorporated by reference in their entirety.

BACKGROUND OF THE INVENTION

1. Field of the Invention

This invention regards a method of positioning a power tong at a pipe joint. More particularly, it regards a method of positioning a power tong at the pipe joint of a pipe, where, after the pipe joint has been brought within the working area of a power tong, the power tong must be displaced to a position that corresponds with that of the pipe joint. A camera which may be displaced in parallel with the pipe, and which is linked to a display, is displaced until the image of the pipe joint coincides with a marker. A signal is then transmitted to a control, indicating that the power tong is to be displaced to a position that coincides with the camera and thereby the pipe joint. Preferably, the control, which receives information about the relative positions of the camera and the power tong, is programmed to guide the power tong to said position. The invention also regards a device for implementation of the method.

2. Description of the Related Art

When screwing together and unscrewing pipe strings, e.g. in connection with drilling in the ground, power tongs are typically used for the actual screwing operation. The positioning of the power tong, which in addition to the actual power tong also comprises a backup tong, at the pipe joint must be relatively accurate to avoid damage to the pipe couplings, and to ensure the success of the screwing operation.

A pipe string may for instance consist of drill pipes or casing. In this context, the term pipes also includes other equipment such as drill collars or tool components that are commonly connected into a pipe string.

According to prior art, the power tong is guided to the correct position by an operator near the power tong. It is also known to place sensors by the pipe string, the sensors being arranged to indicate to position of the pipe joint, so that the power tong can then automatically be guided to the correct position.

US document 2005/0104583 describes an apparatus for positioning pipe joints by means of so-called eddy current. Position measuring by use of an eddy current field will only provide an approximate position report, due to the relatively "blurred" change in the eddy current field at the approach of the pipe joint.

Safety reasons dictate that preferably, personnel should not be present on the drill floor during the operations in question. Furthermore, sensors have turned out not to be capable of indicating the position of the pipe joint with sufficient accuracy. The reason for this is, among other things, that the sensors can hardly take into account the fact that the pipe components have been repaired or for other reasons have different dimensions.

The object of the invention is to remedy or reduce at least one of the drawbacks of prior art.

The object is achieved in accordance with the invention, by the features stated in the description below and in the following claims.

SUMMARY OF THE INVENTION

When positioning a power tong at the pipe joint of a pipe, where, after the pipe joint has been brought within the working area of the power tong, the power tong must be displaced to a position that corresponds with that of the pipe joint, a camera which may be displaced in parallel with the pipe, and which is linked to a display, is displaced in the direction of the pipe joint until the image of the pipe joint coincides with a marker. A signal is then transmitted to a control, indicating that the power tong is to be displaced to a position that coincides with the camera and thereby the pipe joint, the control, which receives information about the relative positions of the camera and the power tong, preferably being programmed to guide the power tong to said position.

The marker, which preferably appears in the display, may be e.g. crosshairs in the display, in the camera optics or an electronically generated marker.

Preferably, the camera, which is directed at the pipe string, can be displaced along a guide by means of an actuator. The guide is secured to a point at a fixed height relative to the power tong. The actuator may be an electric motor coupled to a feed screw, or it may be a hydraulic cylinder. The actuator is controlled by a first transducer, preferably via the control.

The display, which displays an image of the pipe string at the current vertical height of the camera, is placed near the first transducer to allow an operator to operate the first transducer based on what can be seen in the display.

Preferably, upon receiving a signal from the first transducer indicating that the camera is in the correct position by the pipe joint, the control will automatically guide the power tong to the desired position by the pipe joint.

The method and device of the invention provides a reliable, remote controlled and relatively favourably priced solution for positioning a power tong at a pipe joint.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
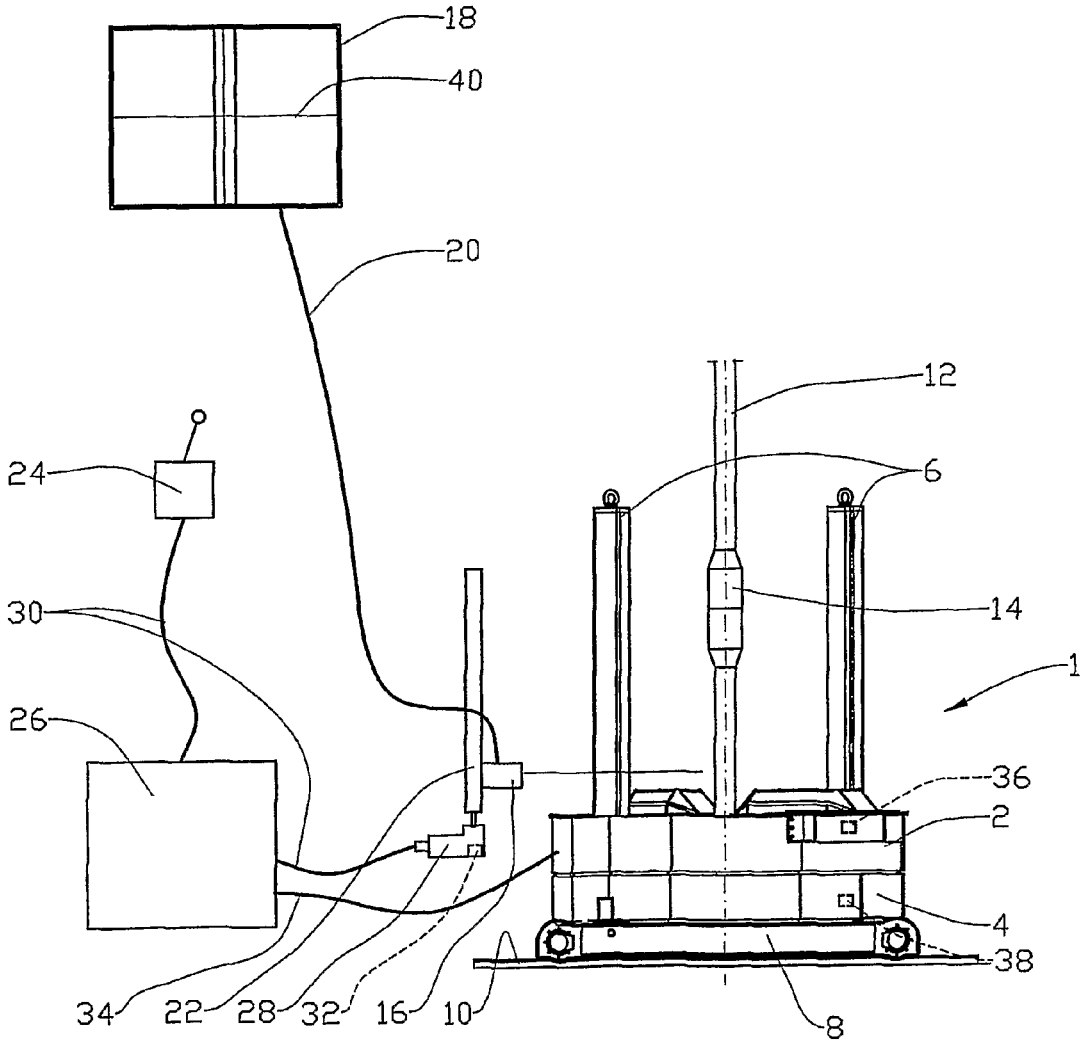
FIG. 1 is a schematic view of a power tong in an idle position, and where a pipe joint is placed inside the working area of the power tong.

In the drawings, reference number 1 denotes an assembly of a power tong 2 and a backup tong 4 arranged jointly or separately to move vertically along columns 6. The columns 6 are mounted on a pedestal 8, and the entire assembly 1 can be displaced on a drill floor 10.

A pipe string 12 extends through the assembly 1. Together, the power tong 2 and the backup tong 4 are arranged to make up and break the pipe joints 14 of the pipe string 12 by the tongs 2, 4 being placed on separate parts of the pipe joint 14 and gripping the pipe as the power tong 2 rotates the upper part of the pipe string 12 in the desired direction while the backup tong 4 holds the other part of the pipe string 12 still.

A camera 16 connected to a display 18 by a line 20 is directed at the pipe string 12, the display 18 showing an image of the pipe string 12.

The camera 16 can be displaced, preferably in parallel with the pipe string 12, by means of a guide 22. The camera 16 is controlled by a first transducer 24, a programmable control 26 and a motor 28 by means of a feed screw (not shown). Lines 30 connect the first transducer 24 and the motor 28 to the control 26.

The motor 28 is provided with a second transducer 32, which in a manner that is known per se is arranged to deliver a signal to the control 26, so that the control 26 can keep track of the relative position of the camera 16.

The control 26 is connected to the power tong 2 and the backup tong 4 via a line 34. The control 26 is arranged to control the displacement of the tongs 2, 4 along the columns 6, and also to keep track of the relative positions of the tongs 2, 4 by means of signals from a third transducer 36 and a fourth transducer 38.

Figure 2:
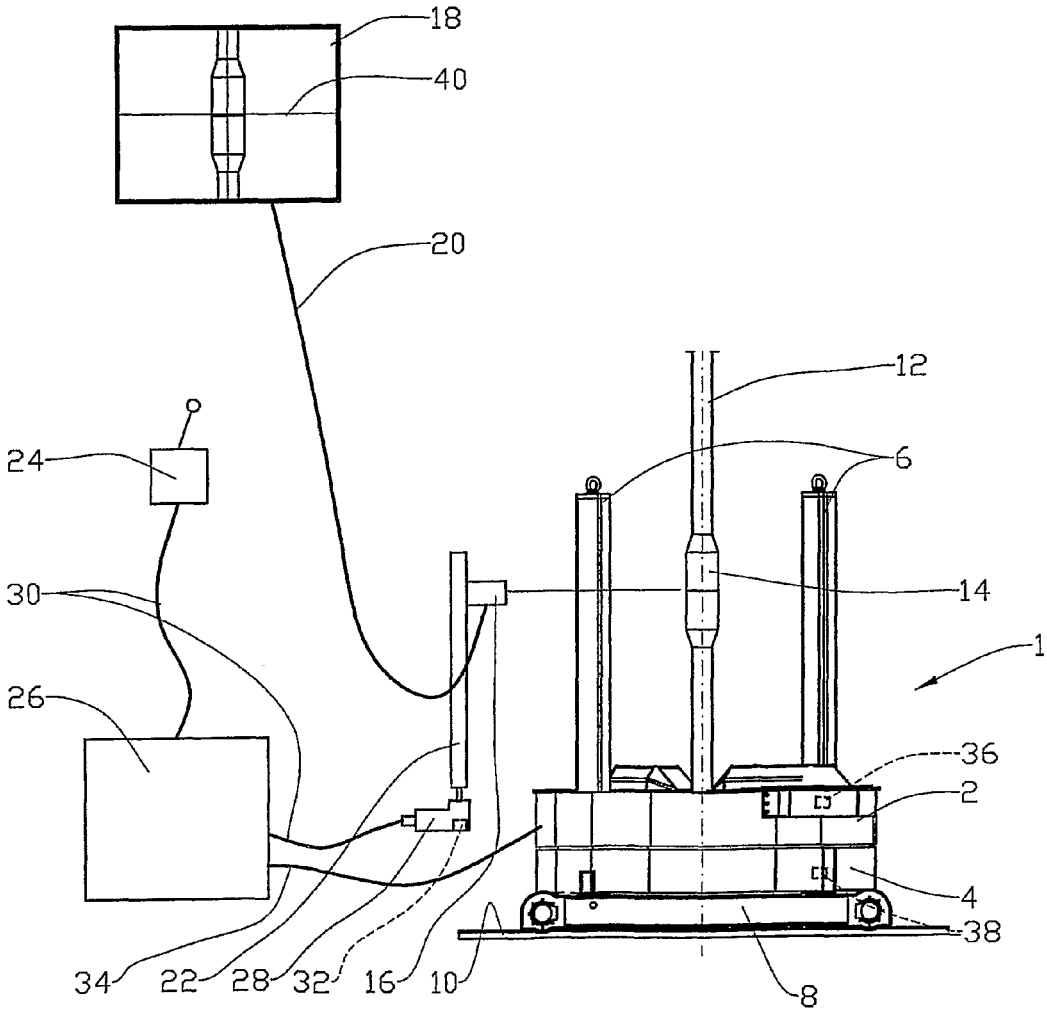
FIG. 2 is similar to FIG. 1, but here a camera has been displaced to a position that corresponds with that of the height of the pipe joint, an image of the pipe joint in a connected display coinciding with a marker in the display.

When the pipe joint 14 of the pipe string 12 is within the working area of the tongs 2, 4, see FIG. 1, the first transducer 24 is operated, whereupon the camera 16 is displaced in the direction of the pipe joint 14 until the pipe joint 14, more particularly visible break between the parts of the pipe joint 14, coincides with a marker 40 in the display 18, see FIG. 2.

Figure 3:
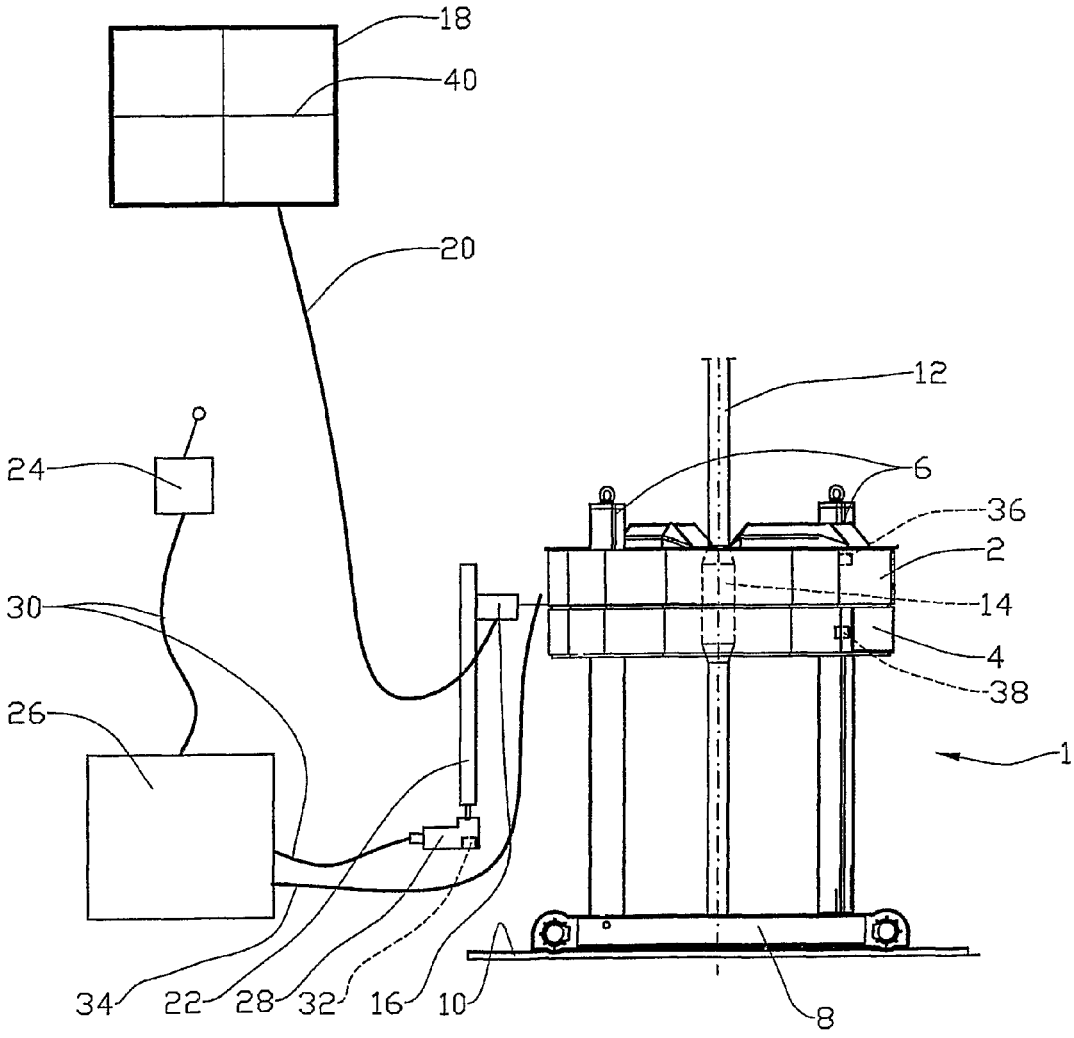
FIG. 3 is a schematic view of the power tong displaced to a position that corresponds with that of the camera, the power tong also being in a desired position relative to the pipe joint.

Then a signal is transmitted to the control 26 via the first transducer 24, instructing the tongs 2, 4 to move, preferably automatically, along the pipe string 12 to a position that corresponds with that of the camera 16. This position coincides with the position of the pipe joint 14; see FIG. 3, whereupon a pipe string portion can be uncoupled from a pipe string 12 in a manner that is known per se.

While the foregoing is directed to embodiments of the invention, other and further embodiments of the invention may be devised without departing from the basic scope thereof, and the scope thereof is determined by the claims that follow.

The invention claimed is:

1. A method of positioning a power tong at a pipe joint of a pipe string, the method comprising:

providing a camera movement assembly for displacing a camera, the camera movement assembly including a guide member oriented substantially in parallel with the pipe string, an actuator and a transducer;

moving the camera independent of the power tong and substantially in parallel with the pipe string along the guide member using the actuator;

stopping the movement of the camera when an image of the pipe joint coincides with a marker in a display;

transmitting a signal via a line from the transducer to a control for the power tong; and controlling the movement of the power tong to the pipe joint based upon the signal.

2. The method in accordance with claim 1, wherein the control, which receives information about the relative positions of the camera and the power tong, automatically guides the power tong to the correct position.

3. The method in accordance with claim 1, further comprising tracking the position of the camera using a second transducer that is coupled to the actuator and is in communication with the control.

4. The method in accordance with claim 3, further comprising tracking the position of the power tong using a third transducer that is coupled to the power tong and is in communication with the control.

5. The method in accordance with claim 4, further comprising controlling the movement of the power tong using the control and the tracked position of the camera.

6. The method in accordance with claim 1, further comprising monitoring an image of the pipe string on the display while moving the camera substantially parallel to a longitudinal axis of the pipe string.

7. The method in accordance with claim 1, further comprising sending a signal to the control when the image coincides with the marker automatically moving the power tong in response to the signal to the position that corresponds to the location of the pipe joint.

8. The method in accordance with claim 1, wherein the camera is configured to move while the power tong remains substantially stationary.

9. A positioning device for positioning a power tong at a pipe joint of a pipe string, the positioning device comprising:

a camera that is displaceable independent of the power tong and substantially in parallel with the pipe string, wherein the camera is arranged to be displaced until an image of the pipe joint coincides with a marker in a display;

a camera movement assembly for displacing the camera, the camera movement assembly including a guide member oriented substantially in parallel with the pipe string, an actuator for moving the camera along the guide member and a transducer; and a control for the power tong connected to the camera movement assembly via a line, the control is arranged to receive a signal from the transducer in the camera movement assembly and control the movement of the power tong to a position that corresponds with that of the pipe joint.

10. The device in accordance with claim 9, wherein the actuator is an electric motor.

11. The device in accordance with claim 9, wherein the actuator is a hydraulic cylinder.

12. The device in accordance with claim 9, wherein the transducer is operable to track the position of the camera.

13. The device in accordance with claim 12, further comprising a second transducer that is in communication with the control and operable to track the position of the power tong.

14. The device in accordance with claim 9, wherein the control is configured to automatically move the power tong to a position that corresponds with a location of a pipe joint of the pipe string when the image of the pipe joint is displayed on the display.

15. The device in accordance with claim 9, wherein the camera is configured to move while the power tong remains substantially stationary.

* * * * *